US010820088B2

(12) United States Patent
Zalisk et al.

(10) Patent No.: US 10,820,088 B2
(45) Date of Patent: Oct. 27, 2020

(54) ACTIVE NOISE REDUCTION EARPHONE

(71) Applicant: Bose Corportion, Framingham, MA (US)

(72) Inventors: Michael Andrew Zalisk, Arlington, MA (US); Kyle James DeCubellis, Southborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/161,779

(22) Filed: Oct. 16, 2018

(65) Prior Publication Data

US 2020/0120412 A1 Apr. 16, 2020

(51) Int. Cl.

| | |
|---|---|
| ***H04R 1/10*** | (2006.01) |
| ***H04R 1/02*** | (2006.01) |
| ***H04R 1/08*** | (2006.01) |

(52) U.S. Cl.

CPC ..... *H04R 1/1083* (2013.01); *H04R 1/023* (2013.01); *H04R 1/086* (2013.01); *H04R 1/1016* (2013.01); *H04R 2460/01* (2013.01)

(58) Field of Classification Search

CPC .... H04R 1/1083; H04R 1/1041; H04R 1/086; H04R 1/1016; H04R 2460/01; H04R 25/604; H04R 1/023; G10K 2210/1081; G10K 11/178

USPC ..... 381/71.1, 71.6

See application file for complete search history.

(56) References Cited

U.S. PATENT DOCUMENTS

| | | | | |
|---|---|---|---|---|
| 8,494,200 | B2 * | 7/2013 | Ram | H04R 1/086 381/322 |
| 8,682,001 | B2 | 3/2014 | Annunziato et al. | |
| 9,082,388 | B2 | 7/2015 | Annunziato et al. | |
| 9,792,893 | B1 * | 10/2017 | Gauger, Jr. | H04R 1/1083 |
| 9,934,774 | B1 * | 4/2018 | Lin | G10K 11/1787 |
| 10,123,137 | B2 * | 11/2018 | Chang | H04R 25/604 |
| 10,206,033 | B2 | 2/2019 | Annunziato et al. | |
| 2011/0058702 | A1 * | 3/2011 | Saggio, Jr. | H04R 1/1016 381/380 |
| 2013/0315410 | A1 | 11/2013 | Annunziato et al. | |
| 2017/0318401 | A1 * | 11/2017 | Chang | H04R 25/604 |
| 2018/0020281 | A1 * | 1/2018 | Wurtz | G10K 11/178 |
| 2018/0098146 | A1 * | 4/2018 | Lin | H04R 1/1083 |
| 2018/0213316 | A1 * | 7/2018 | Oishi | H04R 1/1016 |

(Continued)

FOREIGN PATENT DOCUMENTS

WO 2017/147545 A1 8/2017

OTHER PUBLICATIONS

The International Search Report and the Written Opinion of the International Searching Authority dated Jan. 24, 2020 for PCT Application No. PCT/US2019/056493.

*Primary Examiner* — Disler Paul

(74) *Attorney, Agent, or Firm* — Brian M. Dingman; Dingman IP Law, PC

(57) ABSTRACT

An active noise reduction (ANR) earphone with a housing comprising a front cavity and an exit that is fluidly coupled to the front cavity. An acoustic driver is configured to deliver acoustic energy into the front cavity of the housing. A nozzle is coupled to the housing and is configured to direct acoustic energy from the housing exit to a nozzle exit opening. A microphone is located in the nozzle. A compliant sealing structure is coupled to the nozzle and is configured to couple the earphone to an ear of a user.

18 Claims, 5 Drawing Sheets

(56) References Cited

U.S. PATENT DOCUMENTS

| | | | | |
|---|---|---|---|---|
| 2019/0098390 | A1* | 3/2019 | Carino | H04R 1/1016 |
| 2019/0124434 | A1* | 4/2019 | Hiipakka | H04R 1/1075 |

* cited by examiner

ACTIVE NOISE REDUCTION EARPHONE

BACKGROUND

This disclosure relates to an in-ear active noise reduction (ANR) earphone.

In-ear ANR earphones typically have a portion that is located in the ear canal of the user. These earphones may have a nozzle that conducts sound pressure from the audio driver into the ear canal, and a feedback microphone that is located in an acoustic volume of the earphone between the audio driver and the eardrum. The microphone can restrict the open space that is available for air flow through the nozzle, which can have a detrimental effect on the audio quality.

SUMMARY

All examples and features mentioned below can be combined in any technically possible way.

In one aspect, an active noise reduction (ANR) earphone includes a housing comprising a front cavity and an exit that is fluidly coupled to the front cavity, an acoustic driver configured to deliver acoustic energy into the front cavity of the housing, a nozzle coupled to the housing and configured to direct acoustic energy from the housing exit to a nozzle exit opening, a microphone located in the nozzle, and a compliant sealing structure coupled to the nozzle and configured to couple the earphone to an ear of a user. The nozzle may comprise a nozzle wall, and the microphone may be embedded in the nozzle wall such that substantially no portion of the microphone protrudes into the interior of the nozzle.

Examples may include one of the above and/or below features, or any combination thereof. The nozzle wall may comprise an inner section. The nozzle wall inner section may comprise an outer surface, and the nozzle may further comprise an overlay element over at least some of the outer surface of the inner section of the nozzle. The overlay element may comprise a sleeve.

Examples may include one of the above and/or below features, or any combination thereof. The sleeve may comprise a metal tube. The inner section may have a thickness and the metal sleeve may have a thickness, and the inner section may be thicker than the metal sleeve. The sleeve may cover the entire inner section of the nozzle.

Examples may include one of the above and/or below features, or any combination thereof. The inner section of the nozzle may comprise a distal end spaced from the housing, and the sleeve may comprise a distal end that extends beyond the distal end of the inner section. The distal end of the inner section of the nozzle may comprise an end face, and the distal end of the sleeve may comprise a sleeve end face that covers the entire end face of the inner section of the nozzle. The ANR earphone may further comprise a protective mesh screen that covers the nozzle exit opening. This screen may be located between the inner section end face and the sleeve end face.

Examples may include one of the above and/or below features, or any combination thereof. The housing may further comprise an annular recess proximate the nozzle, and the sleeve may comprise a sleeve proximal end that is located in the annular recess. There may be an adhesive joint between the sleeve proximal end and the annular recess. The sleeve may comprise a chamfer at its distal end.

Examples may include one of the above and/or below features, or any combination thereof. The nozzle wall and the housing may both be portions of a unitary structure. The unitary structure may be a molded plastic structure. The nozzle may comprise a distal end spaced from the housing, and the microphone may be closer to the distal end of the nozzle than it is to the housing. The acoustic driver may radiate acoustic energy along a driver radiation axis, and the nozzle may lie along a nozzle longitudinal centerline. The nozzle longitudinal centerline may intersect the driver radiation axis at an angle of no more than 45 degrees.

In another aspect, an active noise reduction (ANR) earphone includes a housing comprising a front cavity and an exit that is fluidly coupled to the front cavity, an acoustic driver configured to deliver acoustic energy into the front cavity of the housing, a nozzle coupled to the housing and configured to direct acoustic energy from the housing exit to a nozzle exit opening, wherein the nozzle comprises a nozzle wall, a microphone embedded in the nozzle wall, and a compliant sealing structure coupled to the nozzle and configured to couple the earphone to an ear of a user. The nozzle wall comprises an inner section that comprises an outer surface. The nozzle further comprises a metal sleeve located over at least some of the outer surface of the inner section of the nozzle.

DETAILED DESCRIPTION

An in-ear style ANR earphone has a housing that carries a driver. The driver delivers acoustic energy into an acoustic cavity at the front of the driver. The acoustic cavity leads to a rigid nozzle that fits in the ear canal and delivers sound directly into the ear canal. An in-ear ANR earphone is further disclosed in U.S. Pat. No. 9,082,388, the entire disclosure of which is incorporated herein by reference for all purposes. The housing and nozzle of an ANR earphone can both be portions of an integral molded plastic structure. The nozzle carries a compliant sealing structure that acoustically seals the nozzle in the ear canal. In the case of feedback-based ANR earphones, there is a feedback microphone that is configured to sense the sound pressure level in the acoustic volume bounded by the driver, the nozzle, the ear canal, and the eardrum.

It is desirable to make the earphone as small as possible while still delivering quality sound. Small in-ear earphones place the driver as close as possible to the entrance to the ear canal, with the feedback microphone even closer to the eardrum. The feedback microphone can restrict the open space available for airflow within the acoustic cavity and/or the nozzle, which can have a detrimental effect on sound quality.

In the present ANR earphone, the feedback microphone, is fully or partially embedded in the wall of the nozzle. Embedding the microphone in the nozzle wall maintains the maximum open space for airflow through the nozzle. The desired rigidity of the nozzle can be maintained by adding a metal sleeve that covers the outer surface of the plastic nozzle wall.

Figure 1:
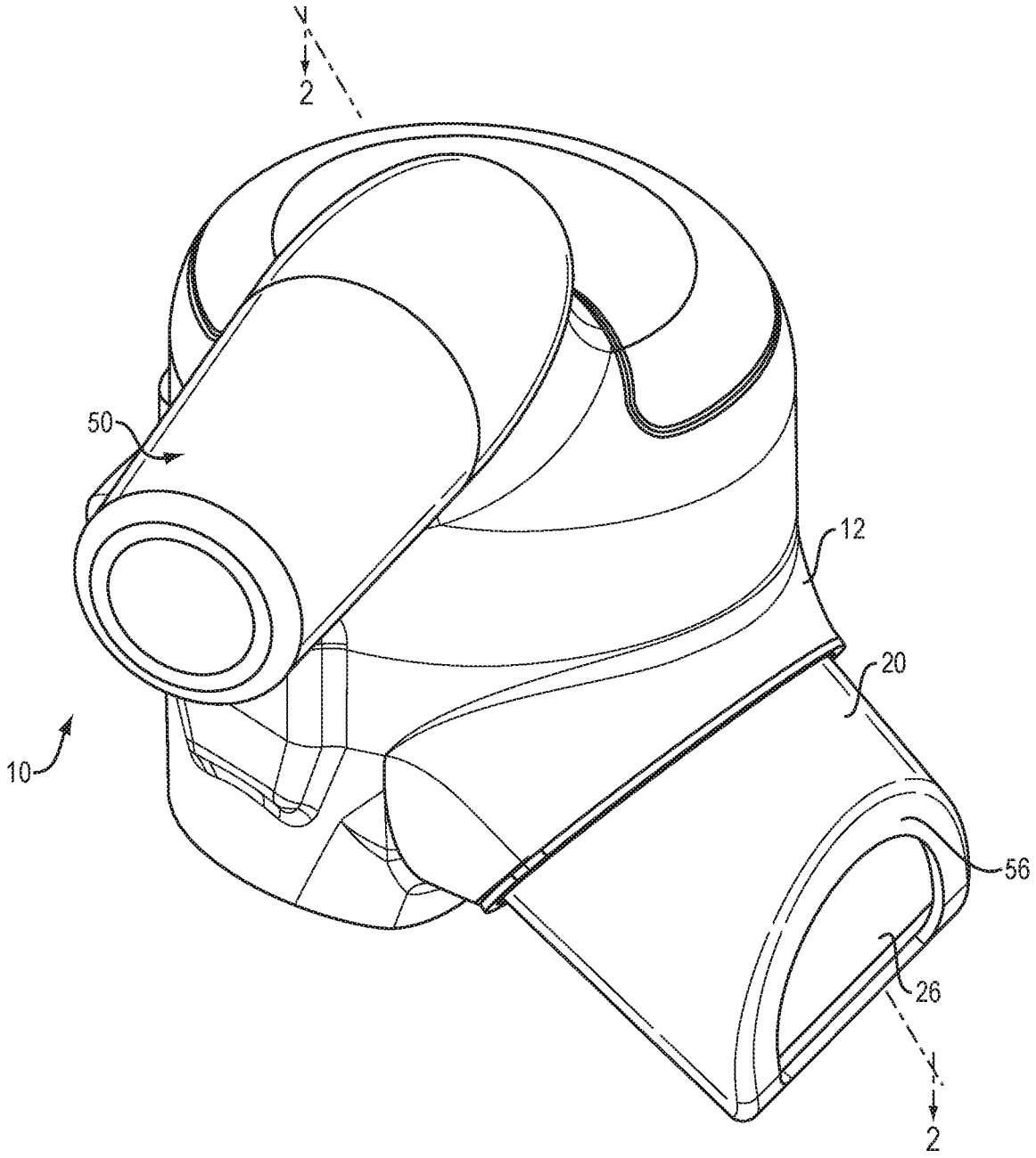
FIG. 1 is a perspective view of an ANR earphone.
Figure 2:
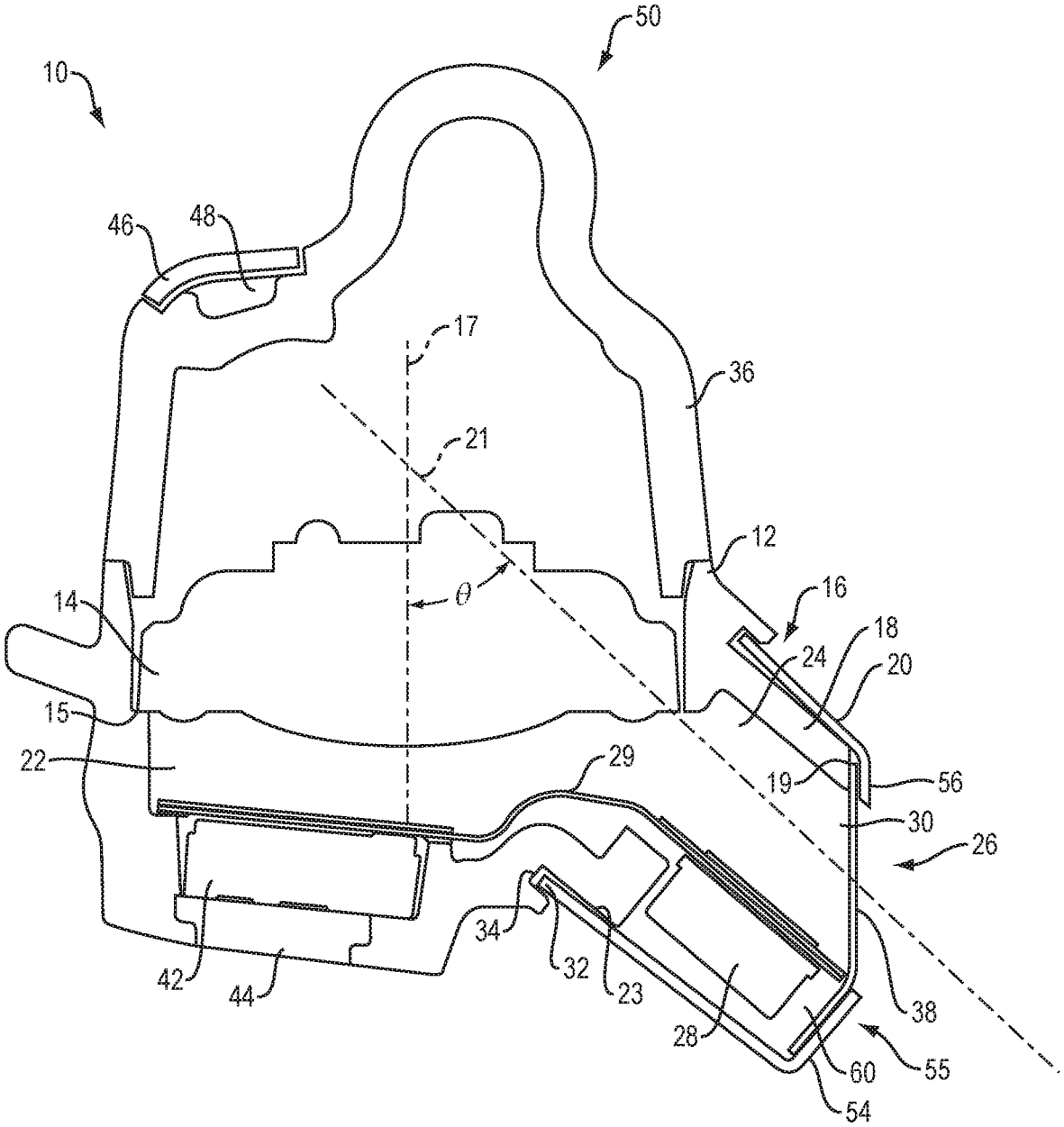
FIG. 2 is a cross-sectional view taken along line 2-2, FIG. 1.
Figure 5:
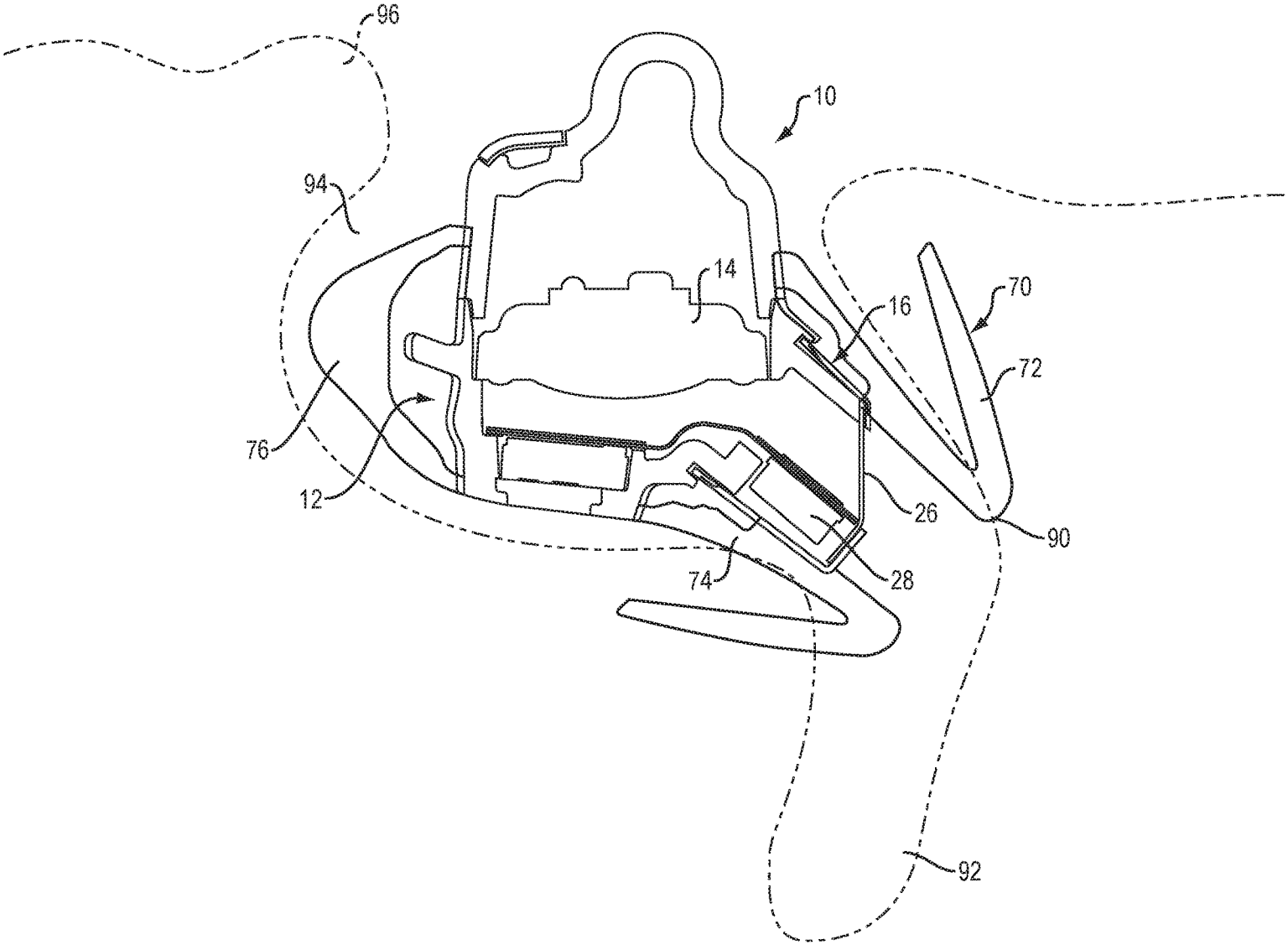
FIG. 5 is a partially schematic cross-sectional view of the ANR earphone of FIG. 1 in an ear of a user.

One non-limiting example of ANR earphone 10 is depicted in the drawings. Referring to FIGS. 1 and 2, earphone 10 includes a housing 12 that carries an acoustic driver 14 that radiates acoustic energy generally along driver radiation axis 17 into front cavity 22. Front cavity exit 24 is fluidly coupled to front cavity 22. A nozzle 16 is coupled to housing 12 and is configured to direct acoustic, energy from front cavity exit 24 to a nozzle exit opening 26. Feedback microphone 28 is located in nozzle 16. Compliant sealing structure 70 is coupled to nozzle 16 and is and configured to couple the earphone to an ear of a user, as depicted in FIG. 5. Note that the interference fit between compliant sealing structure 70 and the housing, the nozzle, and the ear canal is indicated by the overlapping lines in FIG. 5.

Earphone 10 comprises feedback microphone 28. Flex circuit 29 couples the microphone to electronics (not shown) that process the microphone signals. In some examples, infrared (IR) sensor 42, protected by IR window 44, may be used to sense when the earphone is inserted into an ear. Grille 46 covers volume 48 for an external microphone, which in some examples may be a feedforward ANR microphone (not shown). Housing upper portion 36 defines internal volume for other functional aspects of the earphone that are not further described herein. Optional stem 50, when present, can be used for cabling and the like, as is known in the art. In some examples, the earphone 10 comprises wireless earphones with no cable tethering the respective earbuds.

Figure 4:
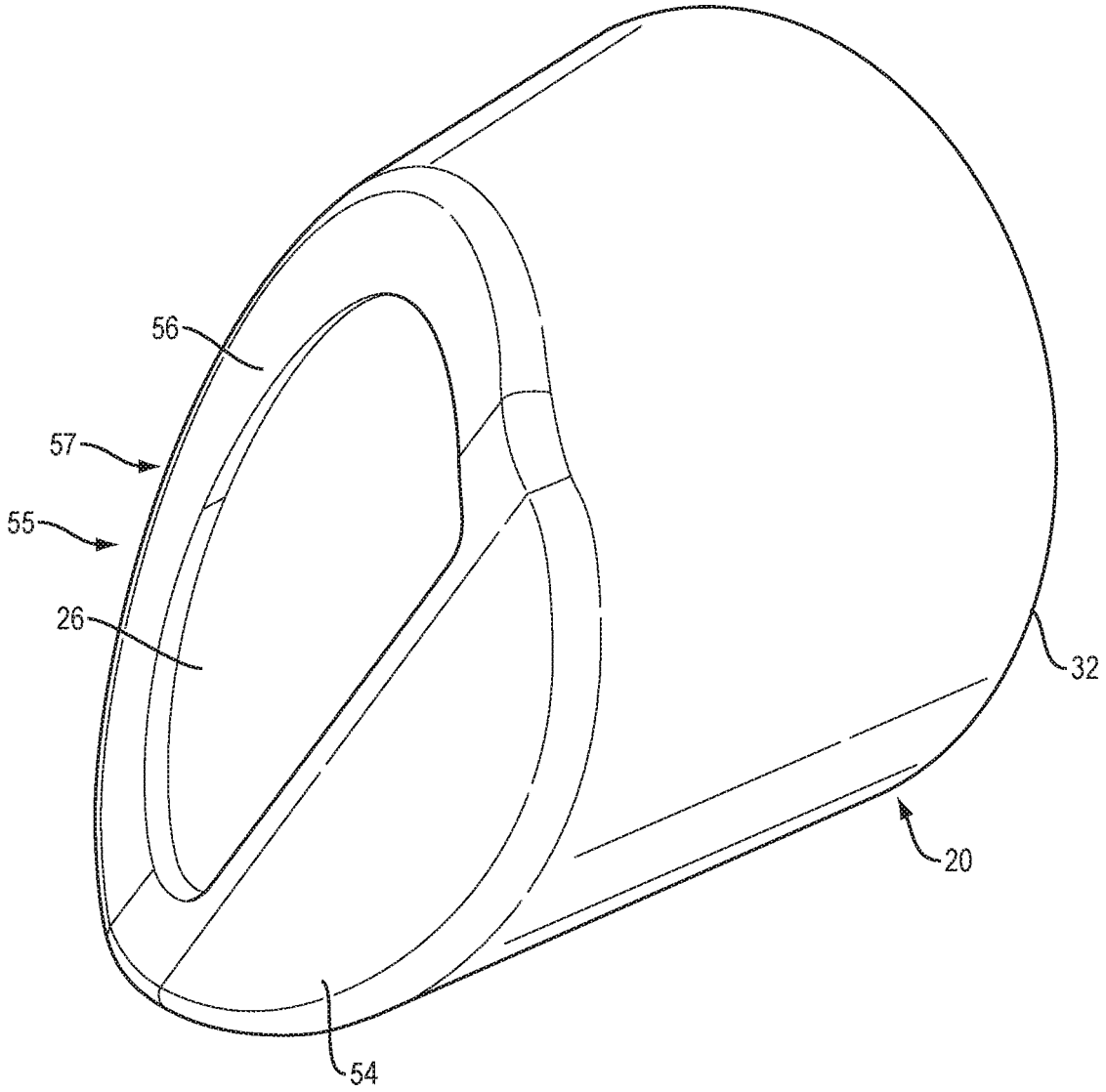
FIG. 4 is a perspective view of the overlay element of the nozzle of the ANR earphone of FIG. 1

Nozzle 16 comprises an inner section 18 which has an outer surface 23. Nozzle 16 further comprises an overlay element 20 over at least some of the outer surface 23 of the inner section of the nozzle. Overlay element 20 in this non-limiting example is a sleeve. The sleeve may be a metal tube, which may be fabricated from aluminum in one non-limiting example. Sleeve 20 may be held in place over nozzle inner section 18 by locating proximal sleeve end 32 in annular recess 34 formed in housing 12. Pressure sensitive adhesive (PSA) can be used to accomplish an adhesive joint between the sleeve proximal end 32 and the annular recess 34. Sleeve 20 may comprise a chamfer 57 at its distal end 55, as depicted in FIG. 4. The nozzle inner section and the housing may both be (but need not be) portions of a unitary structure 13, which may be a molded plastic structure. The molded plastic structure may be fabricated from acrylonitrile butadiene styrene (ABS) or another stiff plastic material.

In one example the inner section 18 of the nozzle is made thinner than it would otherwise be in part due to the addition of the sleeve. In one example, the thickness of the nozzle inner section 18 may be approximately 0.55 mm rather than the previous thickness of 0.75 mm (in examples where the sleeve is not present); a reduction of over 25%. The sleeve may be even thinner than the inner section 18 of the nozzle. In one example the sleeve is aluminum and has a thickness of about 0.2 mm. Sleeve 20 in this non-limiting example covers the entire nozzle inner section 18. Sleeve 20 helps maintain a desired stiffness of the nozzle while also allowing the thickness of the inner section 18 of the nozzle to decrease as compared to a nozzle made entirely from plastic. Also, sleeve 20 helps to protect the microphone from the environment, provides a good interface for the compliant sealing structure 70, and accomplishes a finished appearance to the nozzle.

Referring to FIG. 2, nozzle inner section 18 has distal end 19 that is spaced from housing 12. Sleeve 20 has distal end 55 that extends beyond nozzle inner section distal end 19. Inner section distal end 19 comprises an end face. Sleeve distal end 55 has an end face comprising end bottom face 54 and partially annular end top and side face 55 that together cover the entire end face of the inner section of the nozzle. A protective, mesh screen 38 may be captured between inner section end 19 and tube end 55. Screen 38 may be held in place using, for example, PSA. Screen 38 inhibits moisture and particulates from entering the nozzle, and preferably has a low acoustic resistance so it does not inhibit, sound quality, as is known in the art.

Figure 3:
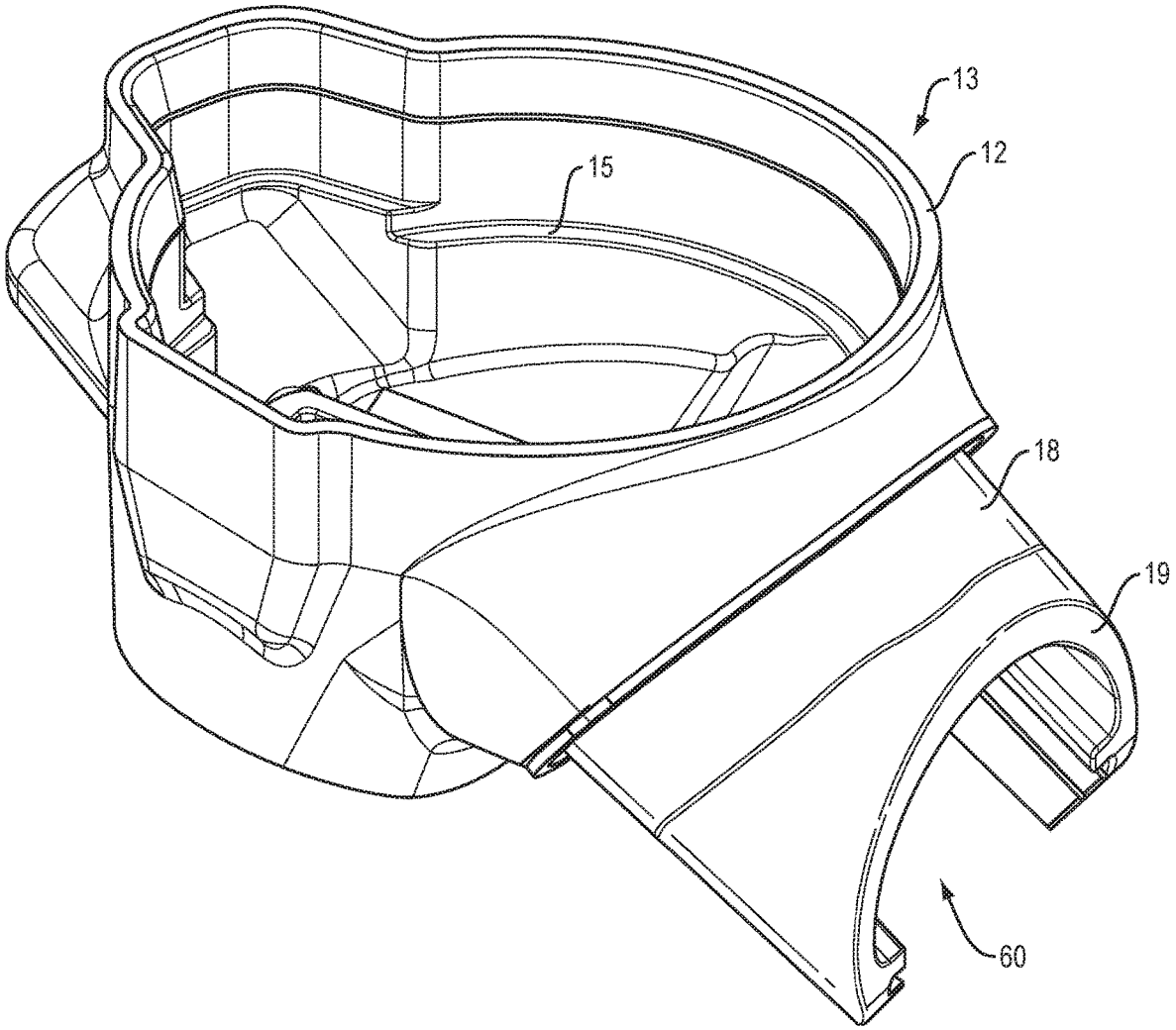
FIG. 3 is a perspective view of the unitary structure of the ANR earphone of FIG. 1 that includes the housing and the inner section of the nozzle.

The feedback microphone 28 (which may be but need not be a micro-electrical mechanical systems (MEMS) microphone) is preferably located as far as possible into the nozzle. In other words, the feedback microphone 28 is preferably pushed as far as possible toward nozzle distal end 19. As depicted in FIGS. 2 and 3, in this non-limiting example this placement can be accomplished by molding an opening 60 into the bottom part of the inner section of the nozzle, at its distal end. Microphone 28 can be located in opening 60 such that microphone 28 is closer to sleeve distal end face 54 than it is to the sleeve proximal end 32. Since the extent of sleeve 20 defines the extent of nozzle 16, the present configuration pushes the microphone as close as possible to the eardrum. This allows feedback microphone 28 to come close to capturing the sound that is heard by the user. If the active noise cancellation is successful in reducing the feedback microphone error signal to zero, a result is that the user will hear sound only from driver 14 and zero noise.

Microphone 28 is partially or fully embedded in nozzle inner section or wall 18, as shown in FIG. 2 where only a small portion of microphone 28 is located in the interior nozzle acoustic volume 30. The microphone thus leaves both the front cavity 22 and the nozzle acoustic volume 30 fully or essentially acoustically unchanged as compared to how their acoustics would be if the microphone was not present.

Nozzle 16 is located generally along nozzle longitudinal centerline 21. Acoustic driver 14 is supported by housing flange 15 and is oriented such that its acoustic radiation axis 17 is transverse to nozzle centerline 21. In one non-limiting example, angle theta of the intersection of axes 17 and 21 is no more than 45 degrees. As shown in FIG. 5, this angle places nozzle 16 into ear canal 92 while housing 12 is located in ear concha 94 that is part of ear pinna 96. Chamfer 57 moves the top of sleeve 20 farther from bend 90 in ear canal 92, so that the nozzle is less likely to contact bend 90. This makes earphone 10 more comfortable to wear for most users. As shown in FIG. 5, compliant sealing structure 70 (which may be but need not be a molded silicone part) has inner part 74 that fits on nozzle 16 and outer flange 72 that seals against the opening of ear canal 92. Compliant sealing structure 70 fits onto nozzle 16, and may also have portion 76 that fits over housing 12, as shown. Other arrangements of sealing structure 70 are contemplated herein.

A number of implementations have been described. Nevertheless, it will be understood that additional modifications may be made without departing from the scope of the inventive concepts described herein, and, accordingly, other examples are within the scope of the following claims.

What is claimed is:

1. An active noise reduction (ANR) earphone, comprising:

a housing comprising a front cavity and an exit of the front cavity;

an acoustic driver configured to deliver acoustic energy into the front cavity of the housing;

a nozzle coupled to the housing and configured to direct acoustic energy from the housing exit to a nozzle exit opening that is spaced from the housing, wherein the nozzle comprises an annular nozzle wall having a thickness and extending along a length of the nozzle from the housing to the nozzle exit opening, wherein the nozzle defines an interior acoustic volume that is bounded by the nozzle wall and is configured to conduct acoustic energy from the housing exit to the nozzle exit opening;

an opening through the entire thickness of a portion of the nozzle wall;

a microphone located in the opening in the nozzle wall and configured so as to leave the nozzle interior acoustic volume largely open such that it conducts the acoustic energy substantially unchanged as compared to the nozzle without the microphone;

a non-compliant sleeve located over the nozzle wall and covering the opening in the nozzle wall; and a compliant sealing structure coupled to an outside of the sleeve and configured to couple the earphone to an ear of a user.

2. The ANR earphone of claim 1, wherein the nozzle wall comprises an inner section with an inner wall surface that bounds the nozzle interior acoustic volume.

3. The ANR earphone of claim 2, wherein the nozzle wall inner section comprises an outer surface that is opposed to the inner wall surface, and wherein the sleeve is located over at least some of the outer surface of the inner section of the nozzle.

4. The ANR earphone of claim 3, wherein the sleeve covers the entire inner section of the nozzle.

5. The ANR earphone of claim 4, wherein the housing further comprises an annular recess proximate the nozzle, and wherein the sleeve comprises a sleeve proximal end that is located in the annular recess.

6. The ANR earphone of claim 5, further comprising an adhesive joint between the sleeve proximal end and the annular recess.

7. The ANR earphone of claim 2, wherein the inner section of the nozzle comprises a distal end spaced from the housing, and wherein the sleeve comprises a distal end that extends beyond the distal end of the inner section.

8. The ANR earphone of claim 7, wherein the distal end of the inner section of the nozzle comprises an end face, and wherein the distal end of the sleeve comprises a sleeve end face that covers the entire end face of the inner section of the nozzle.

9. The ANR earphone of claim 8, further comprising a protective mesh screen that covers the nozzle exit opening.

10. The ANR earphone of claim 9, wherein the screen is located between the inner section end face and the sleeve end face.

11. The ANR earphone of claim 7, wherein the sleeve comprises a chamfer at its distal end.

12. The ANR earphone of claim 1, wherein the sleeve comprises a metal tube.

13. The ANR earphone of claim 12, wherein the nozzle wall inner section has a thickness and the metal sleeve has a thickness, and wherein the nozzle wall inner section is thicker than the metal sleeve.

14. The ANR earphone of claim 1, wherein the nozzle wall and the housing are both portions of a unitary structure.

15. The ANR earphone of claim 14, wherein the unitary structure is a molded plastic structure.

16. The ANR earphone of claim 1, wherein the nozzle comprises a distal end spaced from the housing, and wherein the microphone is closer to the distal end of the nozzle than it is to the housing.

17. The ANR earphone of claim 1, wherein the acoustic driver radiates acoustic energy along a driver radiation axis, wherein the nozzle lies along a nozzle longitudinal centerline, and wherein the nozzle longitudinal centerline intersects the driver radiation axis at an angle of no more than 45 degrees.

18. An active noise reduction (ANR) earphone, comprising:

a housing comprising a front cavity and an exit of the front cavity;

an acoustic driver configured to deliver acoustic energy into the front cavity of the housing;

a nozzle coupled to the housing and configured to direct acoustic energy from the housing exit to a nozzle exit opening that is spaced from the housing, wherein the nozzle comprises an annular nozzle wall having a thickness and extending along a length of the nozzle from the housing to the nozzle exit opening, wherein the nozzle defines an interior acoustic volume that is bounded by the nozzle wall and is configured to conduct acoustic energy from the housing exit to the nozzle exit opening;

an opening through the entire thickness of a portion of the nozzle wall;

a microphone located in the opening in the nozzle wall and configured so as to leave the nozzle interior acoustic volume largely open such that it conducts the acoustic energy substantially unchanged as compared to the nozzle without the microphone;

a metal sleeve located over the entire nozzle wall and covering the opening in the nozzle wall; and a compliant sealing structure coupled to an outside of the sleeve and configured to couple the earphone to an ear of a user.

* * * * *